US011780624B2

(12) United States Patent
Ma et al.

(10) Patent No.: US 11,780,624 B2
(45) Date of Patent: Oct. 10, 2023

(54) DEVICE FOR BINDING ROD BUNDLES

(71) Applicants: Taiyuan University of Science and Technology, Taiyuan (CN); High-End Equipment and Rail Transit Technology R & D Center of Hai'an Taiyuan University of Science and Technology, Nantong (CN)

(72) Inventors: Lifeng Ma, Taiyuan (CN); Jingfeng Zou, Taiyuan (CN); Rongjun Wang, Taiyuan (CN); Ziyong Ma, Taiyuan (CN)

(73) Assignees: TAIYUAN UNIVERSITY OF SCIENCE AND TECHNOLOGY, Taiyuan (CN); HIGH-END EQUIPMENT AND RAIL TRANSIT TECHNOLOGY R & D CENTER OF HARAN TAIYUAN UNIVERSITY OF SCIENCE AND TECHNOLOGY, Nanyong (CN)

( * ) Notice: Subject to any disclaimer, the term of this patent is extended or adjusted under 35 U.S.C. 154(b) by 194 days.

(21) Appl. No.: 17/382,296

(22) Filed: Jul. 21, 2021

(65) Prior Publication Data

US 2022/0111983 A1 Apr. 14, 2022

(30) Foreign Application Priority Data

Oct. 10, 2020 (CN) ..... 202011078648.2

(51) Int. Cl.
*B65B 27/10* (2006.01)
*B65B 13/18* (2006.01)

(52) U.S. Cl.
CPC ..... *B65B 27/10* (2013.01); *B65B 13/185* (2013.01)

(58) Field of Classification Search
CPC ..... B65B 13/02; B65B 13/18; B65B 13/185; B65B 13/186; B65B 13/187; B65B 13/188; B65B 27/10
See application file for complete search history.

(56) References Cited

U.S. PATENT DOCUMENTS 4,463,667 A * 8/1984 Jones ..... A01G 23/006 100/2
8,234,976 B2 * 8/2012 Harr ..... B65B 27/10 100/29

FOREIGN PATENT DOCUMENTS

CN 208498872 U * 2/2019
CN 208916348 U * 5/2019

OTHER PUBLICATIONS

Translation of CN-208916348 (Year: 2019).*
Translation of CN-208498872 (Year: 2019).*

* cited by examiner

*Primary Examiner* — Bobby Yeonjin Kim
(74) *Attorney, Agent, or Firm* — Matthias Scholl P.C.; Matthias Scholl

(57) ABSTRACT

A device for binding rod bundles includes a tilting apparatus, a wire stripper, a binding apparatus, and a collection apparatus. The tilting apparatus includes a tilting platform, a hydraulic cylinder, and an articulated base. The wire stripper includes a main body, a first sliding mechanism, a second sliding mechanism, a first slide block, and a second slide block. The binding apparatus includes an electric clamp, a clamping frame, a sliding rail, a rail base, and a drive motor. The collection apparatus is hinged to the tilting apparatus; the wire stripper is disposed below the tilting apparatus; the tilting platform includes a hinge hole for receiving one end of the clamping frame. The collection apparatus includes a shaft hole for receiving one end of the tilting platform. The (Continued)

hydraulic cylinder is hinged to the articulated base and the other end of the tilting platform is hinged to the hydraulic cylinder.

3 Claims, 5 Drawing Sheets

DEVICE FOR BINDING ROD BUNDLES

CROSS-REFERENCE TO RELATED APPLICATIONS

Pursuant to 35 U.S.C. § 119 and the Paris Convention Treaty, this application claims foreign priority to Chinese Patent Application No. 202011078648.2 filed Oct. 10, 2020, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to the field of transportation of hot-rolled rods, and more particularly, to a device for binding rod bundles.

Steel rods are material made by hot rolling. Currently, the hot rolling operations includes smelting, continuous casting, roughing rolling, semi-finishing rolling, and finishing rolling. Because of limitation on the span of a plant, the rough rolled rods are processed on a U-shaped production line or transferred to another factory for further processing. To improve the transfer efficiency between processes, the existing production mode is provided with a plurality of single stations to work in groups for wire cutting. The cutting is performed artificially with a wire stripper, which is costly and laborious.

The following disadvantages are associated with the artificial cutting methods:

1. workers operate in a narrow space under the rods due to a limited height of the rods from the ground;
2. when cutting the binding wires with the thermal wire stripper, the workers may be scalded by high-temperature oxide scales;
3. the workers cannot reach up to the binding wires due to narrow spacing between the rod bundles; and
4. when the multiple binding wires are cut simultaneously, the workers may be injured by the falling rod bundles that are unpacked first.

SUMMARY

The disclosure provides a device for binding rod bundles, which reduces the labor intensity of workers and improves the working environment.

The device comprises a tilting apparatus, a wire stripper, a binding apparatus, and a collection apparatus. The collection apparatus is disposed on a foundation and is hinged to the tilting apparatus. The wire stripper is disposed below the tilting apparatus and is movable in the XY-plane defined by an X-axis and a Y-axis. The binding apparatus is disposed on the titling apparatus so as to be movable on the X-axis and to rotate around the Z-axis perpendicular to the XY-plane. A crane operates to lift and lower the rod bundles and to transport the rod bundles to the tilting platform. The hydraulic cylinder shakes slightly up and down, which causes the tilting platform to swing up and down and thus spreads the rod bundles evenly on the tilting platform, providing convenience for the binding apparatus and a visual recognition system to determine the position of a binding wire. The binding apparatus tightens the binding wire from the upper side of the rod bundles, and the wire stripper cuts the binding wire from the lower side of the rod bundles. When the binding apparatus withdraws the binding wire and returns to original position, the tilting apparatus shakes slightly up and down, and the binding wire is thus easily taken out from the gaps in the rod bundles.

The tilting apparatus comprises a tilting platform, a hydraulic cylinder, and an articulated base. The tilting platform comprises an axis hole. The collection apparatus comprises a shaft hole for receiving one end of the tilting platform. The collection apparatus is in the shape of a hook with a flat bottom. The hydraulic cylinder is hinged to the articulated base and the other end of the tilting platform is hinged to the hydraulic cylinder, so that the hydraulic cylinder drives the tilting platform to rotate around the axis hole of the tilting platform, which provides convenience for the rod bundles to fall into the collection apparatus.

The wire stripper comprises a main body, a first sliding mechanism, a second sliding mechanism, a first slide block, and a second slide block. The first sliding mechanism comprises a first lead screw and the second slide block comprises a second lead screw. The main body is fixedly disposed on the first slide block and the first slide block is connected to the first lead screw. Each end of the first sliding mechanism is fixedly disposed on the second slide block. The second slide block is connected to the second lead screw.

The binding apparatus comprises an electric clamp, a clamping frame, a sliding rail, a rail base, and a drive motor. The tilting platform further comprises a hinge hole for receiving one end of the clamping frame so that the clamping frame is rotatable around a hinge shaft in response to an external force. The sliding rail is disposed on the clamping frame and the electric clamp is hinged to the rail base. When the drive motor is energized, the rail base drives the electric clamp to slide in the Y-axis. The electric clamp comprises a first jaw, a second jaw, a clamping cylinder, a clamping member, and a micro servo motor comprising an output shaft. The clamping cylinder is disposed in the clamping member. One end of the clamping cylinder is fixedly connected to the first jaw and the second jaw is disposed on the clamping member. When the clamping cylinder contracts, the first jaw moves up and down, so that the electric clamp is switched between in an open state and a close state. The other end of the clamping frame is connected to the output shaft of the micro servo motor so that the electric clamp is driven by the micro servo motor to rotate around the Z-axis.

The collection apparatus is in the shape of a hook with a flat bottom.

The following advantages are associated with the device of the disclosure:

The device of the disclosure is used to simultaneously bind multiple rods and transfer multiple rod bundles to improve the efficiency of transportation between the operations. The device cuts the binding wires from the lower side of the multiple rod bundles, preventing the cut binding wires from falling down between the rod bundles. The device automatically collects the binding wires.

Figure 1:
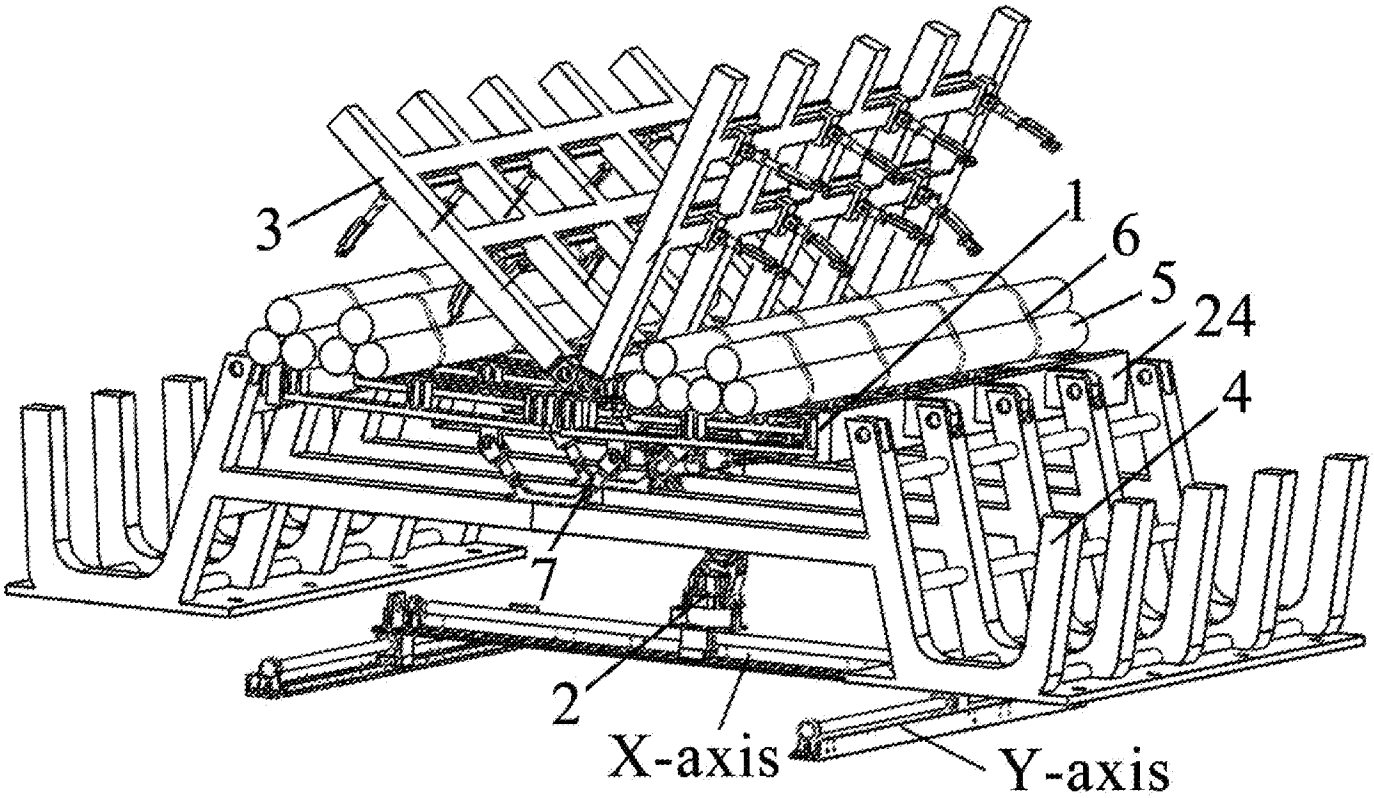
FIG. 1 is a schematic diagram of a device for binding rod bundles according to one embodiment of the disclosure.

In the drawings, the following reference numbers are used: 1. Tilting apparatus; 2. Wire stripper; 3. Binding apparatus; 4. Collection apparatus; 5. Rod bundles; 6. binding wire; 7. Hydraulic cylinder; 8. Articulated base; 9. Main body; 10. First sliding mechanism; 11. Second sliding mechanism; 12. Electric clamp; 13. Clamping frame; 14. Sliding rail; 15. First slide block; 16. Second slide block; 17. Rail base; 18. Drive motor; 19. First jaw; 20. Second jaw; 21. Clamping cylinder; 22. Clamping member; 23. Micro servo motor; and 24. Tilting platform.

DETAILED DESCRIPTION

To further illustrate the disclosure, embodiments detailing a device for binding rod bundles are described below. It should be noted that the following embodiments are intended to describe and not to limit the disclosure.

Referring to FIGS. 1-5, a device for binding rod bundles comprises a tilting apparatus 1, a wire stripper 2, a binding apparatus 3, and a collection apparatus 4. The tilting apparatus 1 comprises a tilting platform 24, a hydraulic cylinder 7, and an articulated base 8. The tilting platform 24 comprises an axis hole. The collection apparatus 4 comprises a shaft hole for receiving one end of the tilting platform 4. The hydraulic cylinder 7 is hinged to the articulated base 8 and the other end of the tilting platform 24 is hinged to the hydraulic cylinder 7, so that the hydraulic cylinder 7 drives the tilting platform 24 to rotate around the axis hole of the tilting platform 24. The tilting platform 24 swings up and down to spread rod bundles evenly on the tilting platform 24, which provides convenience for the visual recognition of the wire stripper 2 and the binding apparatus 3.

Figure 2:
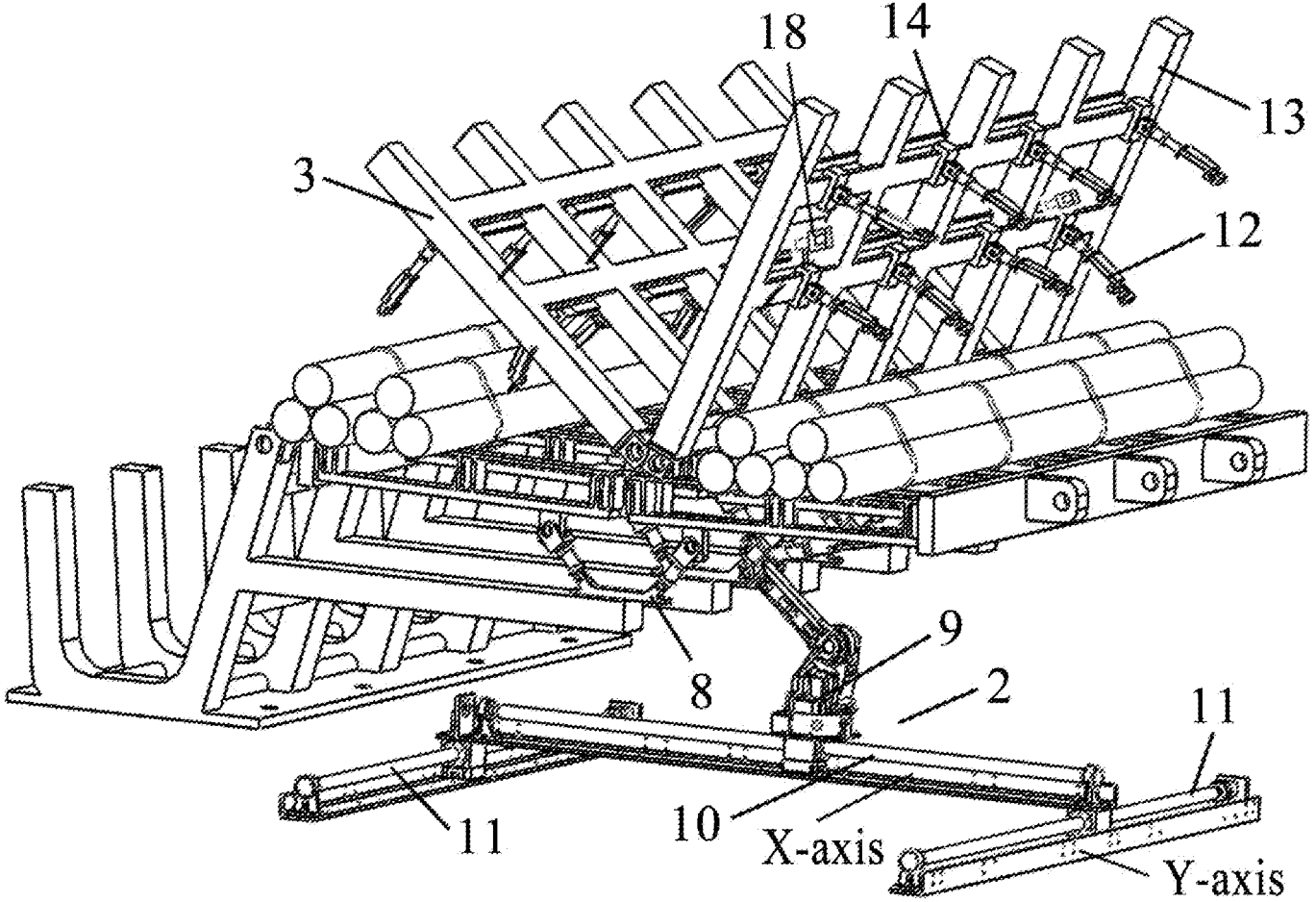
FIG. 2 is a schematic diagram of a device for binding rod bundles according to one embodiment of the disclosure.
Figure 4:
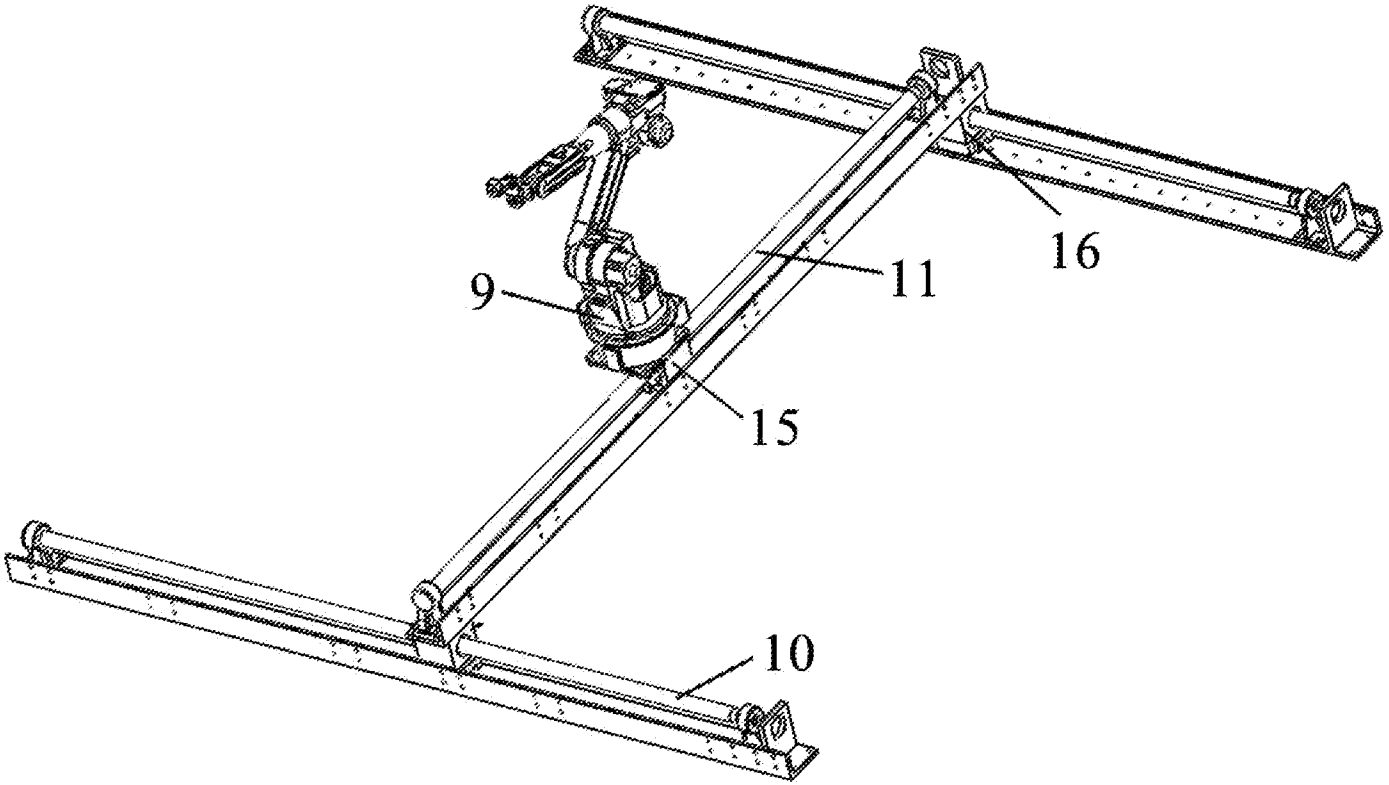
FIG. 4 is a schematic diagram of a wire stripper according to one embodiment of the disclosure.

Referring to FIGS. 1, 2, and 4, the wire stripper 2 comprises a main body 9, a first sliding mechanism 10, a second sliding mechanism 11, a first slide block 15, and a second slide block 16. The first sliding mechanism 10 comprises a first lead screw and the second slide block 16 comprises a second lead screw. The main body 19 is disposed on the first slide block 15 and the first slide block 15 is connected to the first lead screw. Each end of the first sliding mechanism 10 is fixedly disposed on the second slide block 16. The second slide block 16 is connected to the second lead screw. When a motor disposed on one end of the first sliding mechanism is energized, the first sliding mechanism 10 and the second sliding mechanism 11 drive the main body 9 to slide in an XY-plane and cut a binding wire 6.

Figure 3:
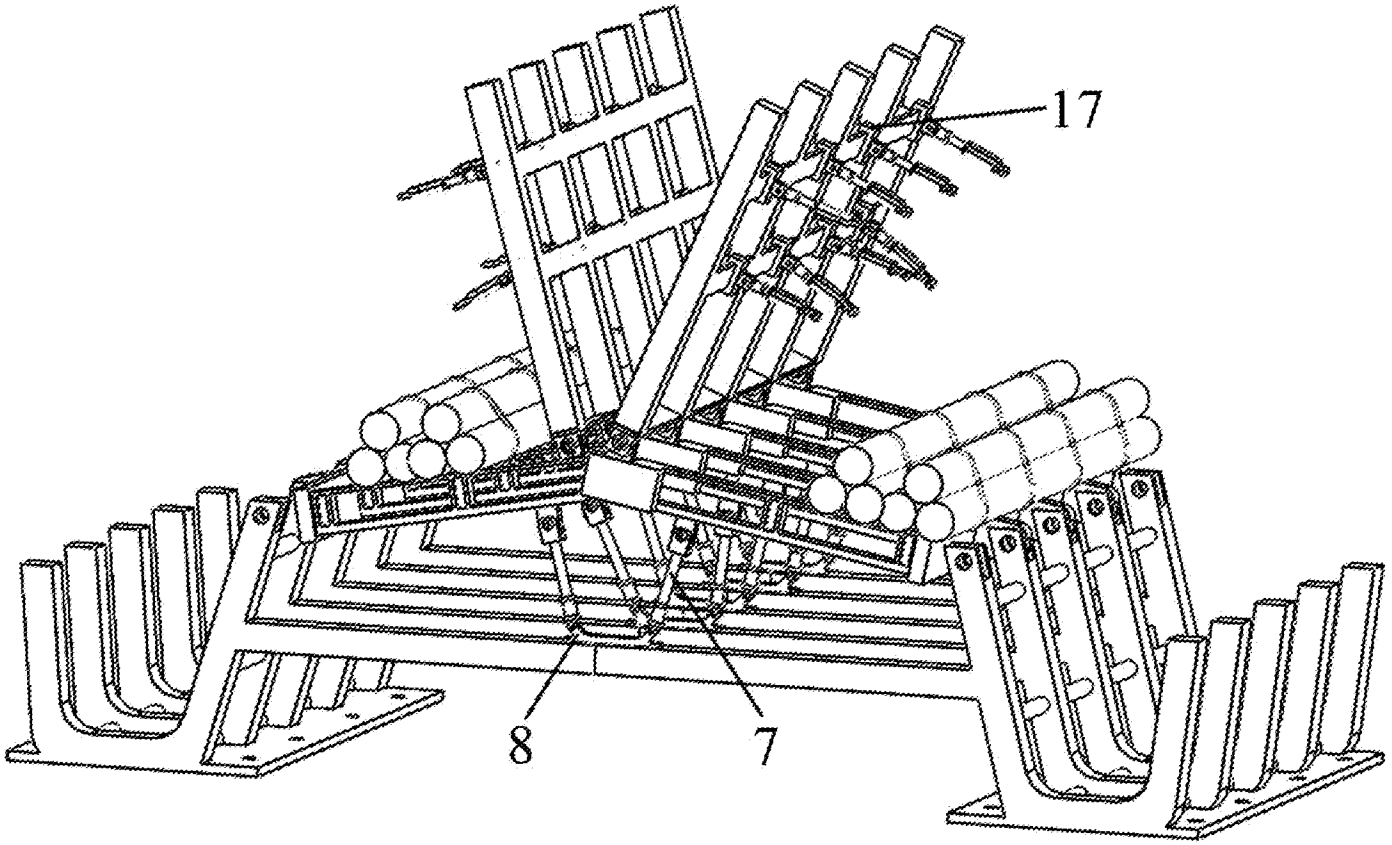
FIG. 3 is a schematic diagram of a tilting apparatus when unloading rods according to one embodiment of the disclosure.
Figure 5:
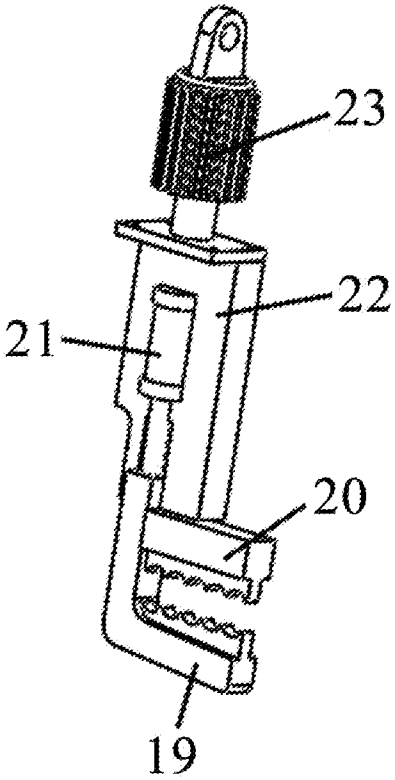
FIG. 5 is a schematic diagram of an electric clamp according to one embodiment of the disclosure.

Referring to FIGS. 2, 3, and 5, the binding apparatus 3 comprises an electric clamp 12, a clamping frame 13, a sliding rail 14, a rail base 17, and a drive motor 18. The tilting platform 24 further comprises a hinge hole for receiving one end of the clamping frame 13. The sliding rail 14 is disposed on the clamping frame 13 and the electric clamp 12 is hinged to the rail base 17. When the drive motor 18 is energized, the rail base 17 drives the electric clamp 12 to slide in the Y-axis. The electric clamp 12 comprises a first jaw 19, a second jaw 20, a clamping cylinder 21, a clamping member 22, and a micro servo motor 23 comprising an output shaft. The clamping cylinder 21 is disposed in the clamping member 22. One end of the clamping cylinder 21 is fixedly connected to the first jaw 19 and the second jaw 20 is disposed on the clamping member 22. When the clamping cylinder 21 contracts, the first jaw 19 moves up and down, alternating between clamping and loosening of the electric clamp 12. The other end of the clamping frame 13 is connected to the output shaft of the micro servo motor 23 so that the electric clamp 12 is driven by the micro servo motor 23 to rotate around the Z-axis. When operating, the electric clamp 12 is kept vertical to the ground surface under gravity. A visual recognition system is configured to determine the position of a binding wire 6 and the clamping frame 13 rotates to an appropriate angle, so that when the drive motor 18 is energized, the rail base 17 drives the electric clamp 12 to a defined position; at the same time, the micro servo motor 23 rotates and then the first jaw 19 is inserted into the gaps in rod bundles, which provides convenience for the electric clamp 12 to loosen and clamp the binding wire 6.

Referring to FIGS. 1 and 2, the collection apparatus 4 is in the shape of a hook with a flat bottom and is fixed on a foundation by an anchor bolt.

The working principle of the device is described detail below: a crane operates to lift and lower the rod bundles 5 and to transport the rod bundles 5 to the tilting platform 24; the hydraulic cylinder 7 shakes slightly up and down at a regular frequency, causing the tilting platform 24 to swing up and down and thus spreading the rod bundles evenly on the tilting platform 24; the visual recognition system is used to scan and determine the spatial position of the binding wire 6; the clamping frame 13 rotates to an appropriate angle; the drive motor 18 drives the rail base 17 to move along the sliding rail 14, thereby driving the electric clamp 12 to a defined position; the micro servo motor 23 rotates and then the first jaw 19 is inserted into the gaps in rod bundles, which provide convenience for the electric clamp 12 to clamp and cut the binding wire 6; the first sliding mechanism 10 and the second sliding mechanism 11 drive the main body 9 to slide and cut the binding wire 6 from below the tilting platform 24; the main body 9 enters the loosened state and returns back to original position; the hydraulic cylinder 7 tilts the tilting platform 24 and the clamping frame 13 is in a clamped state; after the rod bundles falls into the collection apparatus 4, the clamping frame 13 rotates around the hinge hole and returns to the position vertical to the ground; the drive motor 18 drives the rail base 17 to slide along the sliding rail 14 and to move to a predetermined position; the clamping cylinder 21 is released to open the first jaw 19 and the second jaw 20, which allows the binding wire 6 to fall freely under gravity.

It will be obvious to those skilled in the art that changes and modifications may be made, and therefore, the aim in the appended claims is to cover all such changes and modifications.

What is claimed is:

1. A device, comprising:

a tilting apparatus, the tilting apparatus comprising a tilting platform, a hydraulic cylinder, and an articulated base;

a wire stripper, the wire stripper comprising a main body, a first sliding mechanism, a second sliding mechanism, a first slide block, and a second slide block;

a binding apparatus, the binding apparatus comprising an electric clamp, a clamping frame, a sliding rail, a rail base, and a drive motor; and a collection apparatus;

wherein the collection apparatus is disposed on a foundation and is hinged to the tilting platform comprises a hinge hole for receiving one end of the clamping frame;

the collection apparatus comprises a shaft hole for receiving one end of the tilting platform; the hydraulic cylinder is hinged to the articulated base and the other end of the tilting platform is hinged to the hydraulic cylinder;

the first sliding mechanism comprises a first lead screw and the second slide block comprises a second lead screw; the main body is fixedly disposed on the first slide block and the first slide block is connected to the first lead screw; each end of the first sliding mechanism is fixedly disposed on the second slide block; and the second slide block is connected to the second lead screw;

the sliding rail is disposed on the clamping frame and the electric clamp is hinged to the rail base; when the drive motor is energized, the rail base drives the electric clamp to slide in a Y-axis; the electric clamp comprises a first jaw, a second jaw, a clamping cylinder, a clamping member, and a micro servo motor comprising an output shaft; the clamping cylinder is disposed in the clamping member; one end of the clamping cylinder is fixedly connected to the first jaw and the second jaw is disposed on the clamping member; when the clamping cylinder contracts, the first jaw moves up and down, so that the electric clamp is switched between in an open state and a close state; the other end of the clamping frame is connected to the output shaft of the micro servo motor so that the electric clamp is driven by the micro servo motor to rotate around a Z-axis; and the collection apparatus is in the shape of a hook with a flat bottom.

2. The device of claim 1, wherein rod bundles are configured to be synchronously discharged from two symmetrical sides of the tilting apparatus.

3. The device of claim 1, wherein the wire stripper is disposed below rod bundle to cut binding wires from below the tilting platform.

* * * * *